United States Patent [19]

Cooper et al.

[11] Patent Number: 4,473,193

[45] Date of Patent: Sep. 25, 1984

[54] HELICAL FEED-IN MECHANISM FOR STRIP ACCUMULATOR

[75] Inventors: Christopher C. Cooper, Brunswick; Charles R. Krejsa, Northfield, both of Ohio

[73] Assignee: Guild International Inc., Bedford, Ohio

[21] Appl. No.: 457,690

[22] Filed: Jan. 13, 1983

[51] Int. Cl.[3] ..... B65H 75/02; B65H 17/48

[52] U.S. Cl. ..... 242/55; 242/55.21

[58] Field of Search ..... 242/55, 55.21, 78.1, 242/55.19 R; 226/176, 177

[56] References Cited

U.S. PATENT DOCUMENTS

| | | | |
|---|---|---|---|
| 2,320,659 | 6/1943 | Sahlin | 226/176 X |
| 3,258,212 | 6/1966 | La Tour | 242/55 |
| 3,341,139 | 9/1967 | La Tour | 242/55 |
| 3,860,188 | 1/1975 | Bradshaw | 242/55.21 |
| 3,999,718 | 12/1976 | Ziemba | 242/55 |
| 4,012,004 | 3/1977 | Tonellato | 242/55 X |
| 4,048,831 | 9/1977 | Fabian et al. | 226/177 X |
| 4,092,007 | 5/1978 | Weatherby et al. | 242/55 |
| 4,410,121 | 10/1983 | Wheeler et al. | 242/55 X |

*Primary Examiner*—Stuart S. Levy

*Assistant Examiner*—Katherine Jaekel

*Attorney, Agent, or Firm*—Maky, Renner, Otto & Boisselle

[57] ABSTRACT

A feed-in mechanism for feeding strip material in helical fashion into an accumulator while preventing any bending or bowing of the incoming strip material by maintaining the strip material in the helix under tension. The feed-in mechanism includes a plurality of circumferentially spaced, helically arranged strip guides which define a helical path for the incoming strip, and a traction feed and tensioning device respectively located at the entry and exit ends of the helical path. The traction feed pushes the strip material along the helical path while the tensioning device exerts a pulling force on the strip material to maintain the strip material in the helix under tension. The traction feed includes a stationary idler roller and a powered traction roller journaled in a pivoting frame. The pivoting frame is urged towards and away from the stationary idler roller under controlled squeeze pressure to obtain positive traction between the strip material and traction roller, while the overspeed or overdrive of the traction roller is controlled so as not to overtension and consequently permanently deform the strip material being pulled thereby.

21 Claims, 6 Drawing Figures

HELICAL FEED-IN MECHANISM FOR STRIP ACCUMULATOR

DISCLOSURE

This invention relates generally to a strip accumulator wherein a length of strip material being fed from a source of supply, such as an uncoiler, to a mill, machine or other apparatus which processes or uses the strip material, is stored in an expanding and contracting spiral coil so that the mill, machine or other apparatus can be kept running without interruption while the source of strip material is being replenished. More particularly, this invention relates to an improved feed-in mechanism for such an accumulator which feeds incoming strip in helical fashion to the innermost turn of the spiral coil supported by the accumulator. Such a strip accumulator with such a feed-in mechanism may be employed, for example, in a continuous processing line to allow strip material to be continuously fed through the line even while the tail end of a spent coil of the strip material is stopped to permit the lead end of a new coil of strip material to be welded or otherwise attached to such tail end.

BACKGROUND OF THE INVENTION

Strip accumulators heretofore have stored a length of strip material in an expanding and contracting spiral coil having a fixed number of turns with the strip material being fed to the inside of the spiral coil and withdrawn from the outside, or vice versa. Typically, the maximum diameter of the outermost turn of the spiral coil is determined by an outer containment ring or circular array of outer containment rollers whereas the inner diameter of the innermost turn of the spiral coil is determined by an inner containment ring or circular array of inner containment rollers. Accordingly, the difference between the length of coil when fully expanded into engagement with the outer containment ring or rollers and when fully contracted against the inner containment ring or rollers determines the maximum reserve storage capacity of the accumulator for any given gauge and number of turns of the strip material.

In one known type of strip accumulator disclosed in U.S. Pat. No. 3,860,188, an annular ring or array of long, thin, cylindrical rollers support a single spiral coil of strip material with the axis thereof oriented vertically, and such rollers are synchronously driven by individual variable-speed electric motors to rotate the spiral coil of strip material supported thereon to facilitate feeding and withdrawal of the strip material from the spiral coil. The rollers extend radially, or may be slightly skewed and slope downwardly and outwardly to urge the turns of the spiral coil stored thereon outwardly as the rollers rotate.

For feeding the strip material to the innermost turn of the spiral coil, a helical feed-in mechanism is provided which typically includes a driven pair of feed-in or pinch rollers mounted on a helix support cage consisting of one or more pairs of fixedly mounted guide idler rollers which define a desired helical path for the strip material from the pinch rollers to the individually driven rollers supporting the spiral coil.

Although such known feed-in mechanism has been found to operate satisfactorily with heavy gauge strip material, problems have occurred when feeding lighter gauge or very flexible strip material. The lighter gauge strip material may bend or bow as it is fed into and through the helix support cage. When this occurs, it is necessary to remove the bend or bow in the strip material or otherwise the strip material will not properly feed into the accumulator. Sometimes the bend or bow can be removed by manually pushing thereon, but usually it is necessary for the strip material to be backed out of the helix and flattened which is both difficult and time consuming. Moreover, the entire processing line would have to be stopped while the strip material is backed out of the support cage and straightened which obviously has an adverse effect on overall productivity of the processing line.

SUMMARY OF THE INVENTION

The present invention provides an improved helical feed-in mechanism for a strip accumulator which eliminates the aforesaid problems associated with the processing of lighter gauge or very flexible strip material. The feed-in mechanism feeds strip material in helical fashion to the innermost turn of a spiral coil supported by the accumulator while preventing any bending or bowing of the strip material therein by maintaining the strip material in the helix under tension.

Briefly, the feed-in mechanism according to the present invention is characterized by a plurality of circumferentially spaced, helically arranged strip guides which define a helical path for the incoming strip, and a traction feed and tensioning device respectively located at the entry and exit ends of the helical path. The traction feed pushes the strip material along the helical path while the tensioning device exerts a pulling force on the strip material to maintain the strip material in the helix under tension. The tensioning device includes a stationary idler roller and a powered traction roller journaled in a pivoting frame. The pivoting frame is urged towards and away from the stationary idler roller under controlled squeeze pressure to obtain positive traction between the strip material and traction roller, while the overspeed or overdrive of the traction roller is controlled so as not to overtension and consequently permanently deform the strip material being pulled thereby.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
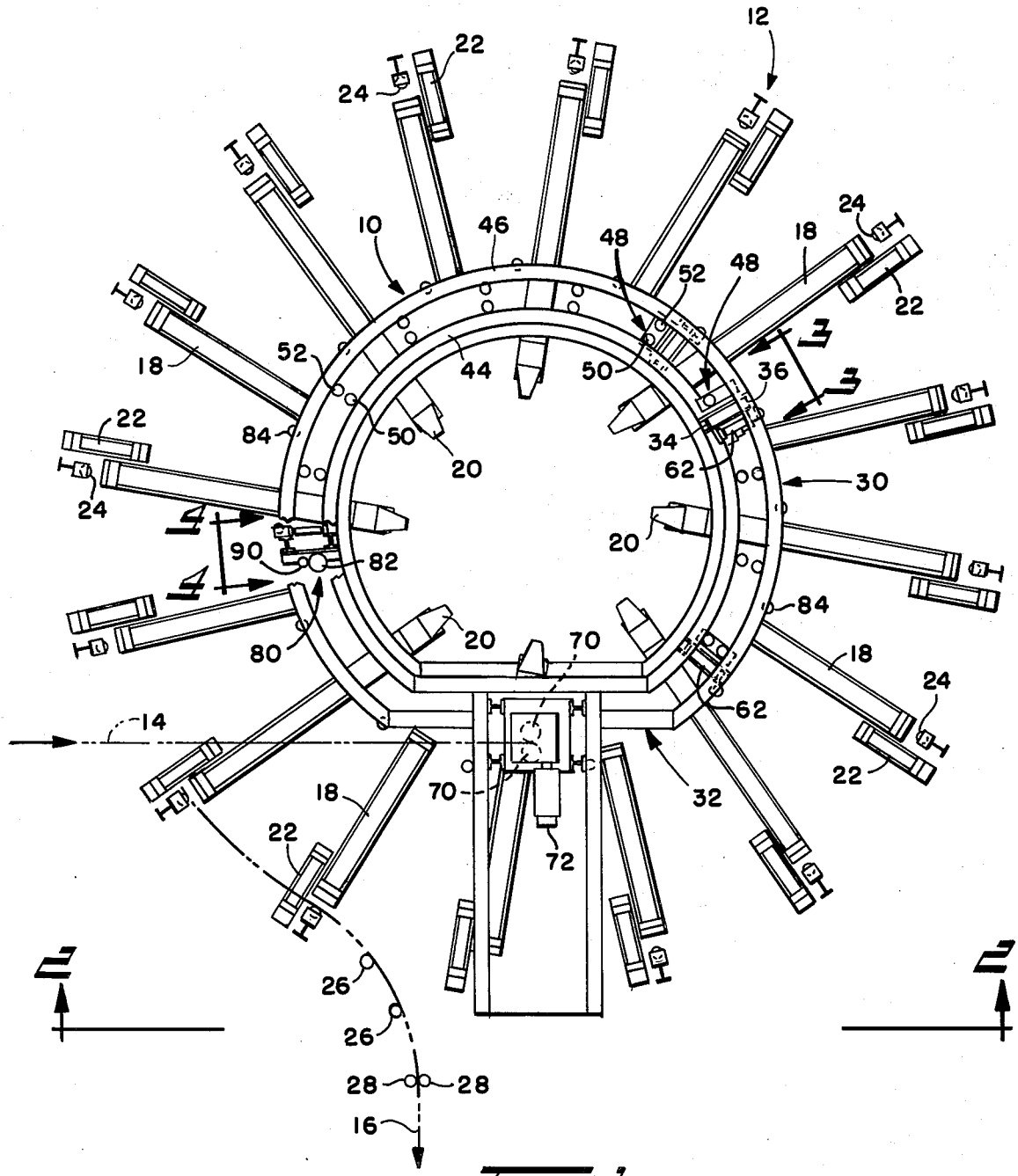
FIG. 1 is a schematic top plan view of a preferred embodiment of helical feed-in mechanism according to the present invention in combination with a strip accumulator of preferred type.
Figure 2:
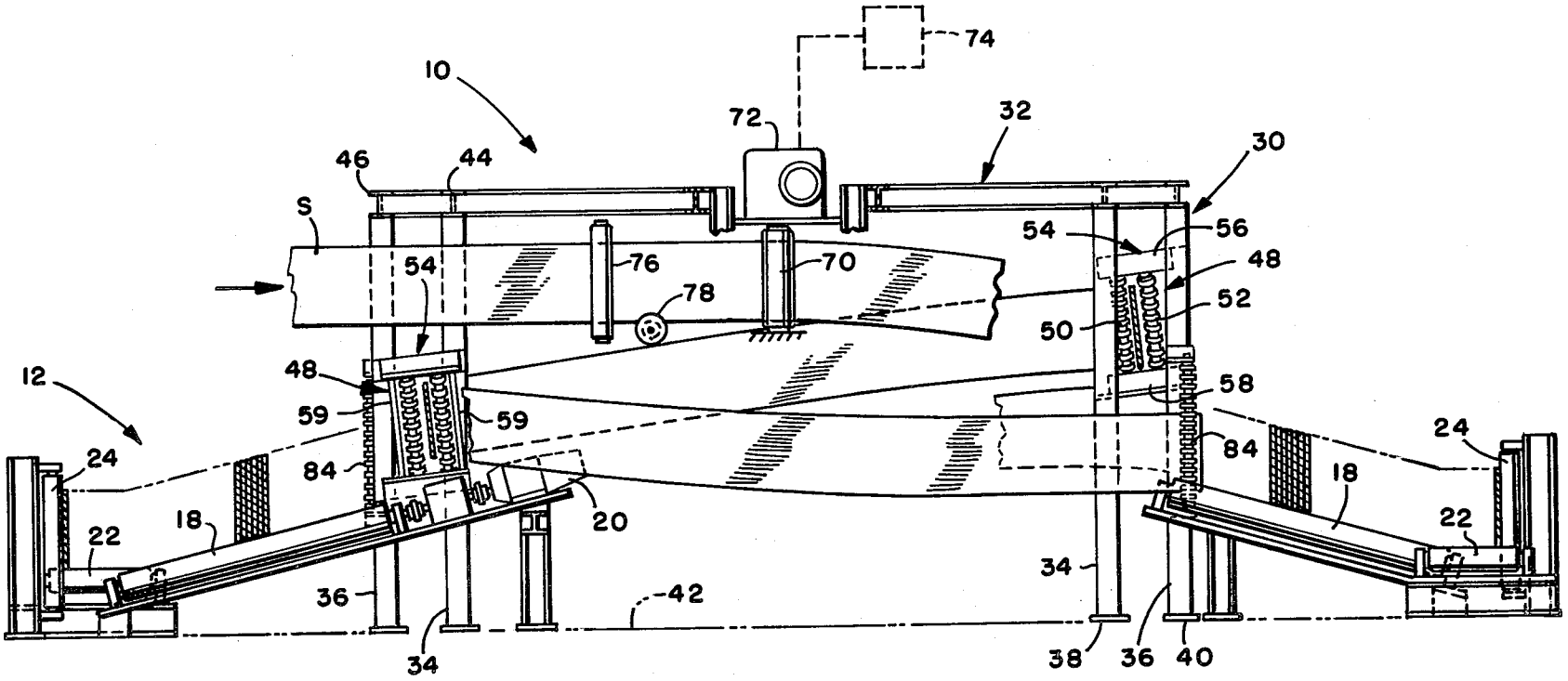
FIG. 2 is an enlarged elevational view of the feed-in mechanism and accumulator of FIG. 1 as generally seen from the line 2—2 thereof, with portions of the feed-in mechanism and accumulator removed and shown in section for illustrative purposes.

Referring now in detail to the drawings and initially to FIGS. 1 and 2, the reference numeral 10 generally designates a helical feed-in mechanism for a strip accumulator indicated generally at 12. The strip accumulator 12 stores a length of strip material, such as sheet metal strip, taken from a coil along path 14, and supplies such strip material along path 16 to a mill, machine or other apparatus without interruption.

GENERAL DESCRIPTION OF THE STRIP ACCUMULATOR

The strip accumulator 12 shown comprises an annular ring or array of rollers 18 for supporting a single spiral coil of strip material with the axis thereof oriented vertically. The rollers 18 (or every other roller as shown) may be synchronously driven by individual variable-speed electric motors 20 to rotate the spiral coil of strip material supported thereon to facilitate feeding and withdrawal of the strip material from the spiral coil. The synchronously driven rollers 18 extend radially, or may be slightly skewed as shown, and preferably slope downwardly and outwardly to urge the turns of the spiral coil stored thereon outwardly as the rollers rotate toward an annular ring or array of radially extending horizontal idler rollers 22. Preferably, the inner ends of the horizontal rollers 22 slightly overlap the outer ends of the driven rollers 18 which are positioned in a slightly lower plane whereby essentially a continuous support surface is provided for the spiral coil.

The accumulator 12 also desirably includes an outer containment ring or circular array of rollers 24 which determine the maximum diameter of the outermost turn of the spiral coil. To provide for withdrawal of the strip material from the outermost turn of the spiral coil, there are provided exit guide rollers 26 which define an arcuate path leading to a pair of pinch rolls 28. The pinch rolls may be controllably driven by a motor to backtension to withdrawn strip as it is fed to the mill along the path 16.

DESCRIPTION OF THE HELICAL FEED-IN MECHANISM

Referring further to FIGS. 1 and 2, the helical feed-in mechanism 10 is located generally centrally of the accumulator 12 and comprises a helix support cage 30 having a frame 32. The frame 32 includes an annular array of circumferentially spaced pairs of radially spaced, inner and outer vertical posts or columns 34 and 36. Each column 34, 36 has a respective footer 38, 40 (see FIG. 2) for mounting to the floor 42 and the top ends of the inner and outer columns are tied together by radially inner and outer rings or annular beams 44 and 46, respectively.

Figure 3:
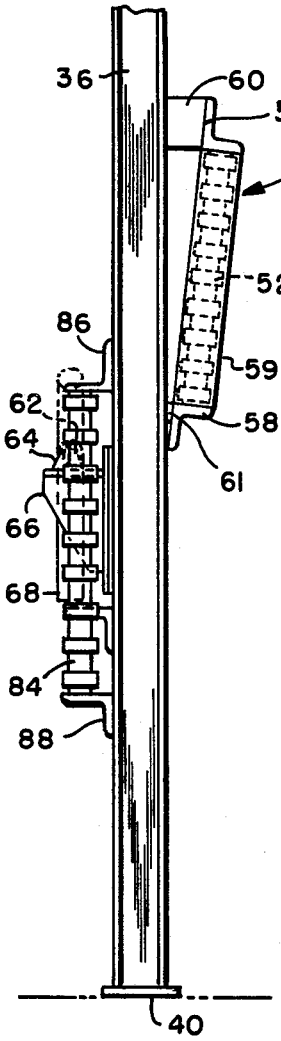
FIG. 3 is a further enlarged partial elevational view of the feed-in mechanism of FIG. 1 as seen from the line 3—3 thereof.

The helix support cage 30 further comprises a plurality of strip guides 48 which together define a helical path for incoming strip material. Each strip guide 48 includes radially inner and outer idler guide rollers 50 and 52 which are parallel and closely spaced to contain and guide the strip material in a narrow path therebetween. The guide rollers are journaled in a rectangular roller frame 54 between the upper and lower frame members 56 and 58 which are vertically spaced and connected by side frame members 59. The roller frame 54 is secured to and between the respective radially inner and outer columns 34 and 36 between which the strip is guided by the guide rollers. As seen in FIGS. 2 and 3, the guide rollers 50, 52 preferably are skewed to the vertical, both circumferentially and radially, to accommodate or match the twist and descent of the strip material as it travels along the helical path.

FIG. 3 shows, in elevation, a representative one of the strip guides 48 which preferably are identical in construction. It is noted however that the strip guides are mounted on respective pairs of inner and outer columns 34 and 36 by respective top and bottom mounting wedges 60 and 61 and associated fasteners at respective heights and inclinations that will vary from one strip guide to another depending on their location along the helical path. It also is noted that each guide roller 50, 52 may consist of a steel cylindrical roll having a plurality of spaced rubber rings along the length thereof to prevent marking or marring of the moving strip material.

One or more of the strip guides 48 may have associated therewith a radially extending lower strip edge support roller 62. As best seen in FIG. 3, such roller 62 is journaled between brackets 64 mounted atop an elevator 66 which is guided for vertical movement along a respective set of inner and outer columns 34 and 36. The elevator 66, and thus the roller 62, may be raised and lowered by a hydraulic actuator or jack 68 to locate and support the strip material in the desired helical path. The number and location of the lower strip edge support rollers may vary as may the number and location of the strip guides, but a sufficient number of each should be provided and located to define the desired helical path of the strip material and reduce stress on the strip material resulting from the weight thereof.

At the entry or upper end of the helix support cage 30, there is provided a pair of feed-in or pinch rollers 70 which are vertically aligned and radially spaced adjacent one another. One or both of the pinch rollers 70 are rotatably driven at a controlled speed by a motor 72 and motor controller indicated diagramatically at 74 in FIG. 2. Also, one of the pinch rolls may be stationary or fixed in position and the other mounted in machine slides and connected to a hydraulic actuator or the like to provide and control pinch pressure on the moving strip material.

To ensure proper entry of the strip material into the helix support cage 30, a pair of vertical entry guide rollers 76 are provided along with a horizontal lower strip edge support roller 78 upstream of the feed-in rollers 70. The edge support roller may be height adjusted as desired to obtain proper entry height of the strip material passing between the feed-in rollers and into the helix support cage.

In accordance with the present invention, a tensioning device 80 is provided at the exit or lower end of the helix support cage 30 which serves to maintain the strip material passing through the support cage under tension. The tensioning device 80 is preferably located in the place where the last strip guide would normally be, and may be provided by substituting a tension pinch roller 82 for the radially inner roller of the last strip guide. In FIG. 1 the tensioning device 80 is shown located at about 9 o'clock whereas the feed-in rollers 70 are located at about 6 o'clock. After passing through the tensioning device, the strip material passes to the innermost turn of the spiral coil supported on the inclined drive rollers 18 and idler rollers 22. It is noted that the minimum permissible diameter of such innermost turn of the spiral coil is determined by a plurality of vertically extending inner containment rollers 84 journaled in upper and lower brackets 86 and 88 secured to and projecting outwardly from respective outer columns 36 as seen in FIGS. 1, 2 and 3. The rollers 84 thus are arranged in an annular ring or array and are also coextensive with and extend upwardly from the radially inner ends of the inclined rollers 18 as seen in FIG. 2.

Figure 4:
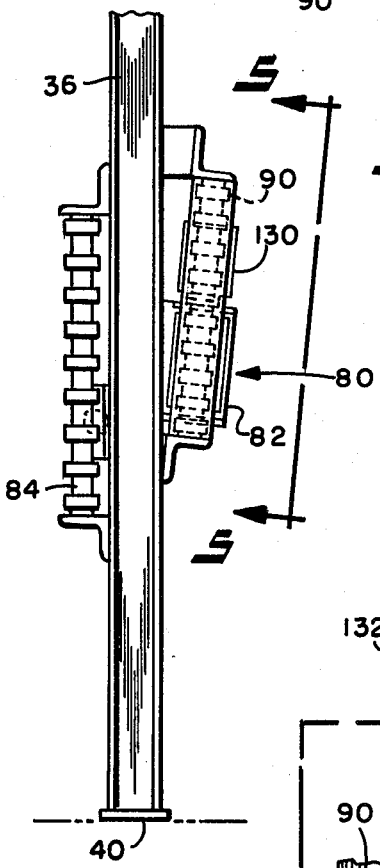
FIG. 4 is another further enlarged partial elevational view of the feed-in mechanism of FIG. 1 as seen from the line 4—4 thereof and showing, in particular, a preferred form of the aforementioned traction device.
Figure 6:
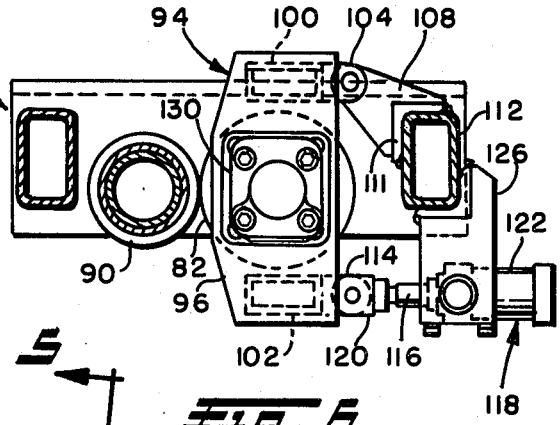
FIG. 6 is a sectional view through the traction device taken along the line 6—6 of FIG. 5.
Figure 5:
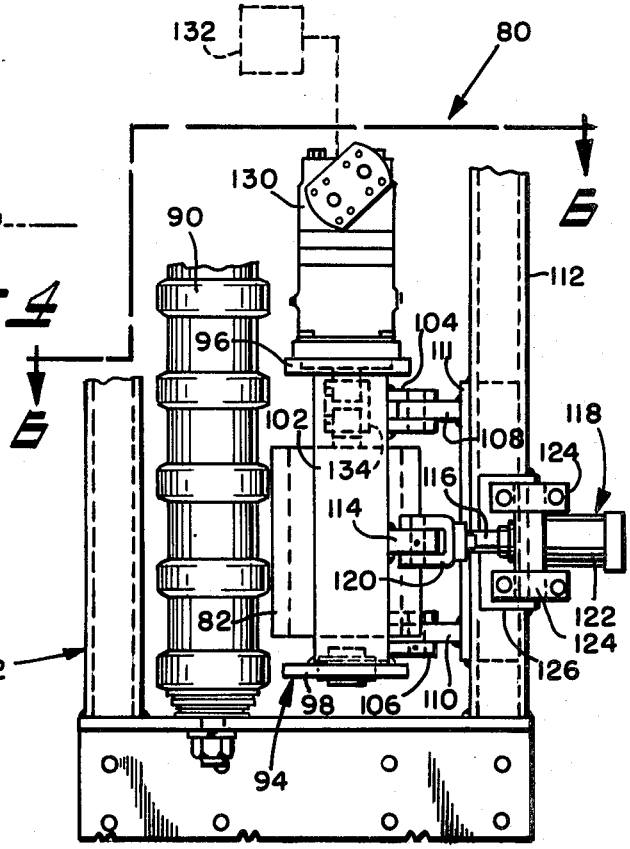
FIG. 5 is a still further enlarged fragmentary elevational view of the traction device of FIG. 4 as generally seen from the line 5—5 thereof, such view being slightly skewed with respect to the vertical line of FIG. 4.

Referring now to FIGS. 4–6, the tensioning device 80 also includes a raidally outer guide or stationary pinch roller 90 which may be mounted similarly to the other radially outer guide rollers 52 in a roller frame 92 which is secured to a respective set of inner and outer columns 34 and 36. On the other hand, the tension pinch roller 82 is journaled for rotation in a pinch roller frame 94 between upper and lower frame plates 96 and 98 which are vertically spaced and connected by side frame members 100 and 102. Secured to the side frame member 100 are a pair of vertically spaced top and bottom clevises 104 and 106 which are pin connected to and supported by respective brackets 108 and 110 secured by a common angle bracket 111 to the radially inner vertical side frame element 112 of the roller frame 92. The other side frame member 102 has secured thereto a bracket 114 to which the rod 116 of a hydraulic actuator 118 is pin connected by a clevis 120. The cylinder 122 of such actuator 118 is pivotally mounted by trunnions 124 and an angle bracket 126 to the side frame element 112. Accordingly, controlled operation of the actuator 118 will move the tension pinch roller 82 towards and away from the stationary roller 90 and control the pinch pressure applied to the strip material moving between the tension pinch roller and stationary roller. As shown, the tension pinch roller may be provided with a rubber sleeve or coating to prevent marring of the strip material and to ensure positive traction. During such pivotal movement, the rotational axis of the tension pinch roller will be maintained parallel to that of the stationary roller which is disposed at the height and inclination corresponding to its location along the helical path.

The tension pinch roller 82, which is shorter than the stationary roller 90 and located at the lower end thereof, is rotatably driven at controlled speed or overdrive as by a hydraulic motor 130 and corresponding controller indicated diagramatically at 132 in FIG. 5. The hydraulic motor is shown mounted atop the upper frame plate 96 and drivingly connected to the tension pinch roller end journal by a coupling 134.

OPERATION

In operation and with particular reference to FIGS. 1 and 2, strip material is directed initially along the path 14 between the entry guide rollers 76 and then the feed-in roller 70 which provide the main or primary driving force for feeding or pushing the strip material into the accumulator 10 via the helix support cage 30. From the feed-in rollers, the strip material is guided along the helical entry path by the strip guides 48 and then, after passing between the tension pinch roller 82 and stationary roller 90 of the tensioning device 80, onto the inclined rollers 18 and/or horizontal rollers 22 intermediate the rings of inner and outer containment rollers 84 and 24. The strip material then is formed into a spiral coil of the desired number of turns before its leading end is guided along the exit guide rollers 26 to and through the withdrawal pinch rollers 28 for passage along the path 16 to the strip material processor, mill or the like. Additional strip material may then be fed into the accumulator until the spiral coil is fully expanded against the ring of outer containment rollers 24 at which time the accumulator is filled to maximum capacity. During loading of the strip material as aforesaid, the inclined rollers 18 may be rotatably driven to facilitate feeding of the strip material and forming of the spiral coil.

When the accumulator 10 is fully loaded, the strip material may be withdrawn therefrom. During normal operation, some or all of the inclined rollers 18 may be continuously rotated at a speed generally corresponding to the rate the strip material is fed into the accumulator by the feed-in mechanism 10, which is desirably substantially the same as the rate of out-feed whereby the reserve capacity of the accumulator will remain substantially the same. However, should the rate of withdrawal of the strip material from the accumulator exceed the rate of in-feed, or the in-feed be stopped altogether, as when welding on a new coil to replenish the supply of strip material, the reserve capacity of the accumulator will still permit withdrawal of the strip material without interruption. During such welding operation, the innermost turn of the spiral coil will contract about the ring of inner containment rollers 84 followed by the next turn and so on. At the same time, the outer turns of the spiral coil that have not as yet been contracted or drawn up against the inner containment rollers will continue to rotate relative to the stationary, contracted innermost turns.

If the feed-in is not resumed in time, the outermost turn of the spiral coil will eventually contract onto the previously contracted turns and the accumulator will not be able to supply any more strip material. However, by proper selection of the size of the strip accumulator in relation to the speed of the mill processor or the like and the gauge of the strip material as well as the time required to weld on a new coil, this condition will normally not occur. Of course, if it does, the strip material may break unless a suitable emergency stop is provided.

After a new coil has been welded on or otherwise attached to the spent coil, the feed of strip material into the accumulator by the feed-in mechanism 10 is resumed at a linear speed greater than that of the strip material being withdrawn. The rate of withdrawal is of course governed by the mill, processor or the like to which the strip material is being fed. As long as the rate of in-feed of the strip material is greater than the out-feed, the coil turns will continue to expand from the outside in. Such higher rate of in-feed may be continued until the accumulator is substantially filled to capacity. At that time, the rate of in-feed of the strip material into the accumulator is desirably adjusted substantially to correspond to the rate of withdrawal therefrom so that once again the maximum reserve of strip material is maintained for the next interruption of the in-feed or until the in-feed is stopped altogether to replenish the source of supply.

As indicated, the strip material exits the feed-in mechanism 10 between the tension pinch roller 82 and stationary roller 90 of the tensioning device 80. To facilitate initial feeding of the strip material therethrough, the hydraulic actuator 118 may be retracted to move the tension pinch roller clear of the stationary roller. After the strip material has been fed between such rollers, the actuator may then be extended to move the tension pinch roller towards the stationary roller and against the strip material under controlled pinch pressure. Preferably, the pinch pressure is set to ensure positive traction (no slippage) between the strip material and tension pinch roller while the latter is slightly overdriven in relation to the feed-in pinch rollers 70 by the motor 130.

By slightly overdriving the tension pinch roller 82, a net pulling force is placed on the strip material at the outlet end of the helix support cage 30. This places and keeps the strip material in the support cage under tension at all times and never allows the strip material to go into compression which may lead to bending or bowing of lighter gauge or very flexible strip material between the strip guides 48 as was heretofore a problem.

If a hydraulic motor 130 is employed as shown, the hydraulic pressure supplied thereto may be adjusted at the controller 132 to vary the tension of the strip material in the support cage 30. Alternatively, an electric motor can be employed whereupon the current can be limited to control the torque applied at the tension pinch roller 82. The overdrive, or overspeed in the event of slippage between the tension pinch roller and strip material, can be controlled by the controller 132 so as not to overtension, stretch or otherwise deform the strip material.

The tension force or applied torque preferably is set for the smallest gauge or lowest yield strength strip material to be stored by the accumulator 10. Although strip material may be able to tolerate higher tension forces as it increases in size or strength, proportionally less tension force is required to ensure against bending or bowing of the strip material because of its correspondingly greater stiffness. As for heavy and relatively stiff strip material which may not need tensioning, such tensioning nevertheless provides added assurance against bending or bowing of the strip material in the helix support cage. Accordingly, there is no need to reset or change the tension force for different gauges of strip material.

As a result of the foregoing, the accumulator 10 can be used not only to store heavy gauge or stiff strip material, but also light gauge or very flexible strip material. For example, strip material on the order of 1½0 millimeters to 3 millimeters thickness and up to 63 inches wide can be processed at speeds on the order of several hundred meters per minute or as high as 500 meters per minute, as in the case of usage in a rolling mill, without the strip material being subjected to bending or bowing in the helix support cage.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the claims.

We claim:

1. In a strip accumulator including support means for supporting an expandable/contractible spiral coil of strip material and withdrawal means for withdrawing strip material from the outermost turn of the spiral coil, the improvement comprising feed-in means for feeding strip material in helical fashion to the innermost turn of the spiral coil while maintaining the strip material in the helix under tension, said feed-in means including strip guide means defining a helical path for the incoming strip material, first traction means at the entry end of said strip guide means for pushing strip material into and through said strip guide means, and second traction means at the exit end of said strip guide means for maintaining the strip material in said strip guide means under tension during movement of the strip material along such helical path prior to entering the innermost turn of such spiral coil.

2. An accumulator as set forth in claim 1, wherein means are provided for overdriving said second traction means in relation to said first traction means to effect tensioning of the strip material during such movement along such helical path, and means are provided for controlling such overdrive so as not to overtension the strip material.

3. An accumulator as set forth in claim 2, wherein different gauges of strip material can be stored by said accumulator, and means are provided for setting such overdrive for the lowest yield strength of strip material to be stored irrespective of the gauge of strip actually being stored.

4. An accumulator as set forth in claim 1, wherein said second traction means includes a pair of pinch rollers and means rotatably to drive one of said pinch rollers.

5. An accumulator as set forth in claim 5, wherein means are provided to move one of said pinch rollers towards and away from the other of said pinch rollers to control the pinch pressure on the strip material.

6. An accumulator as set forth in claim 4, wherein said one of said pinch rollers is journaled in a frame mounted to pivot about an axis parallel to and spaced from the rotational axis of said one of said pinch rollers, and means are provided to pivot said frame for urging said one of said pinch rollers towards and away from the other of said pinch rollers.

7. An accumulator as set forth in claim 6, wherein said means to pivot includes a piston-cylinder assembly.

8. An accumulator as set forth in claim 4, wherein means are provided for mounting said pinch rollers at a height and inclination matching the twist and descent of the helically guided strip material at such exit end of said strip guide means which substantially corresponds to the innermost turn of such spiral coil.

9. An accumulator as set forth in claim 8, wherein said one of said pinch rollers is disposed radially inwardly of the other of said pinch rollers with respect to a radius of the helical path of the strip material.

10. An accumulator as set forth in claim 4, wherein said strip guide means includes a plurality of circumferentially spaced, helically arranged strip guides which support and guide the strip material along the helical path.

11. An accumulator as set forth in claim 10, wherein said strip guides include upright guide rollers about which the strip material passes and radial rollers supporting the lower edge of the strip material.

12. An accumulator as set forth in claim 10, wherein said strip guide means includes a frame and means for mounting said strip guides on said frame at respective heights and inclinations matching the twist and descent of the strip material at their respective locations along the helical path.

13. An accumulator as set forth in claim 12, wherein said frame includes a plurality of circumferentially spaced pairs of radially spaced, inner and outer upright columns between which respective strip guides are mounted.

14. An accumulator as set forth in claim 13, wherein said strip guides are of like construction, each including a pair of closely radially spaced upright idler rollers journaled in a roller frame mounted between a respective pair of said inner and outer upright columns at a height and inclination matching said idler rollers to the twist and descent of the strip material.

15. An accumulator as set forth in claim 14, wherein each roller frame is mounted to the respective pair of upright columns by respective top and bottom wedges.

16. An accumulator as set forth in claim 13, including a plurality of inner containment rollers mounted to respective outer upright columns of said frame for defining the minimum diameter of the innermost turn of the spiral coil.

17. A strip accumulator comprising support means for supporting an expandable/contractable spiral coil of strip material, and feed-in means for feeding strip material in helical fashion to the innermost turn of the spiral coil while maintaining the strip material in the helix under tension, said feed-in means including strip guide means defining a helical path for the incoming strip material, first traction means adjacent the entry end of said strip guide means for pushing strip material into and through said strip guide means, and second traction means adjacent the exit end of said strip guide means for maintaining the strip material in said strip guide means under tension.

18. An accumulator as set forth in claim 17, wherein means are provided for overdriving said second traction means in relation to said first traction means to effect tensioning of the strip material in such helical path, and means are provided for controlling such overdrive so as not to overtension the strip material.

19. An accumulator as set forth in claim 17, wherein said second traction means includes a pair of pinch rollers, means rotatably to drive one of said pinch rollers, and means to move said pinch rollers towards and away from each other to control the pinch pressure on the strip material.

20. In a strip accumulator including support means for supporting an expandable/contractible spiral coil of strip material and withdrawal means for withdrawing strip material from the outermost turn of the spiral coil, the improvement comprising feed-in means for feeding strip material in helical fashion to the innermost turn of the spiral coil while maintaining the strip material in the helix under tension, said feed-in means including strip guide means defining a helical path for the incoming strip material, first traction means at the entry end of said strip guide means for pushing strip material into and through said strip guide means, and second traction means at the exit end of said strip guide means for maintaining the strip material in said strip guide means under tension, said second traction means including a pair of pinch rollers and means rotatably to drive one of said pinch rollers, said one of said pinch rollers being journaled in a frame mounted to pivot about an axis parallel to and spaced from the rotational axis of said one of said pinch rollers, and means for pivoting said frame for urging said one of said pinch roller towards and away from the other of said pinch rollers, said means rotatably to drive including a motor mounted on said frame and directly connected to said one of said pinch rollers.

21. In a strip accumulator including support means for supporting an expandable/contractible spiral coil of strip material and withdrawal means for withdrawing strip material from the outermost turn of the spiral coil, the improvement comprising feed-in means for feeding strip material in helical fashion to the innermost turn of the spiral coil while maintaining the strip material in the helix under tension, said feed-in means including strip guide means defining a helical path for the incoming strip material, first traction means at the entry end of said strip guide means for pushing strip material into and through said strip guide means, and second traction means at the exit end of said strip guide means for maintaining the strip material in said strip guide means under tension, said second traction means including a pair of pinch rollers and means rotatably to drive one of said pinch rollers, and means mounting said pinch rollers at a height and inclination matching the twist and descent of the helically guided strip material at such exit end of said strip guide means, said one of said pinch rollers being shorter than and located adjacent the lower end of the other of said pinch rollers.

* * * * *